US007472059B2

(12) United States Patent
Huang

(10) Patent No.: US 7,472,059 B2
(45) Date of Patent: Dec. 30, 2008

(54) METHOD AND APPARATUS FOR ROBUST SPEECH CLASSIFICATION

(75) Inventor: Pengjun Huang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 2 days.

(21) Appl. No.: 09/733,740

(22) Filed: Dec. 8, 2000

(65) Prior Publication Data

US 2002/0111798 A1 Aug. 15, 2002

(51) Int. Cl.
*G10L 19/00* (2006.01)
*G10L 11/06* (2006.01)

(52) U.S. Cl. ..... 704/220; 704/214; 704/217

(58) Field of Classification Search ..... 704/206–208, 704/210, 213–216, 224, 226, 227, 217, 219–220
See application file for complete search history.

(56) References Cited

U.S. PATENT DOCUMENTS

| | | | | |
|---|---|---|---|---|
| 4,281,218 | A * | 7/1981 | Chuang et al. | 370/435 |
| 4,720,862 | A * | 1/1988 | Nakata et al. | 704/214 |
| 5,414,796 | A * | 5/1995 | Jacobs et al. | 704/221 |
| 5,664,052 | A | 9/1997 | Nishiguchi et al. | |
| 5,680,508 | A * | 10/1997 | Liu | 704/227 |
| 5,727,123 | A | 3/1998 | McDonough et al. | |
| 5,734,789 | A * | 3/1998 | Swaminathan et al. | 704/206 |
| 5,749,067 | A | 5/1998 | Barrett | |
| 5,774,847 | A | 6/1998 | Chu et al. | |
| 5,784,532 | A | 7/1998 | McDonough et al. | |
| 5,937,375 | A | 8/1999 | Nakamura | |
| 6,154,721 | A | 11/2000 | Sonnic | |
| 6,640,208 | B1 * | 10/2003 | Zhang et al. | 704/214 |
| 6,799,161 | B2 | 9/2004 | Yokoyama | |

FOREIGN PATENT DOCUMENTS

| | | |
|---|---|---|
| EP | 0451796 A1 | 10/1991 |
| JP | 2000010577 | 6/1998 |

OTHER PUBLICATIONS

"Sinusoidal Coding" *Speech Coding and Synthesis*, W.B. Kleijn et al., Elsevier 1995 (Ch. 4).

(Continued)

*Primary Examiner*—Angela A Armstrong
(74) *Attorney, Agent, or Firm*—Michael DeHaemer; Timothy F. Loomis; Thomas R. Rouse

(57) ABSTRACT

A speech classification technique for robust classification of varying modes of speech to enable maximum performance of multi-mode variable bit rate encoding techniques. A speech classifier accurately classifies a high percentage of speech segments for encoding at minimal bit rates, meeting lower bit rate requirements. Highly accurate speech classification produces a lower average encoded bit rate, and higher quality decoded speech. The speech classifier considers a maximum number of parameters for each frame of speech, producing numerous and accurate speech mode classifications for each frame. The speech classifier correctly classifies numerous modes of speech under varying environmental conditions. The speech classifier inputs classification parameters from external components, generates internal classification parameters from the input parameters, sets a Normalized Autocorrelation Coefficient Function threshold and selects a parameter analyzer according to the signal environment, and then analyzes the parameters to produce a speech mode classification.

63 Claims, 8 Drawing Sheets

OTHER PUBLICATIONS

"Multimode and Variable-Rate Coding of Speech" *Speech Coding and Synthesis*, W.B. Kleijn et al., Elsevier 1995 (Ch. 7).
"Linear Predictive Coding of Speech" *Digital Processing of Speech Signals*, L.R. Rabiner et al., Prentice Hall Signal Processing Series, Alan V. Oppenheimer, New Jersey (Ch. 8).
A.M. Kondoz (1994) Digital Speech, Coding for Low Bit Rate Communications Systems. John Wiley & Sons, Ltd., ISBN 0 471 95064 5; pp. 64-65.
International Search Report PCT/US01/46971, International Search Authority - European Patent Office - Jan. 7, 2002.

* cited by examiner

| CURRENT / PREVIOUS | SILENCE | UNVOICED | VOICED | UP-TRANSIENT | TRANSIENT | DOWN-TRANSIENT |
|---|---|---|---|---|---|---|
| SILENCE | Vad=0 | nacf_ap[3] very low, zcr high, bER low, vER very low | X | DEFAULT | X | X |
| UNVOICED | Vad=0 | nacf_ap[3] very low, nacf_ap[4] very low, nacf very low, zcr high, bER low, vER very low, E < Eprev | X | DEFAULT | X | X |
| VOICED | Vad=0 | vER very low, E < Eprev | DEFAULT | X | nacf_ap[1] low, nacf_ap[3] low, E > 0.5 * Eprev | vER very low, nacf_ap[3] not too high, |
| UP-TRANSIENT, TRANSIENT | Vad=0 | vER very low, E < Eprev | DEFAULT | X | nacf_ap[1] low, nacf_ap[3] not too high, nacf_ap[4] low, previous classification is not transient | nacf_ap[3] not too high, E > 0.05 * vEav |
| DOWN-TRANSIENT | Vad=0 | vER very low | X | X | E > Eprev | DEFAULT |

FIG. 5A

| CURRENT / PREVIOUS | SILENCE | UNVOICED | VOICED | UP-TRANSIENT | TRANSIENT | DOWN-TRANSIENT |
|---|---|---|---|---|---|---|
| SILENCE | Vad=0 | DEFAULT | X | nacf_ap[2], nacf_ap[3] and nacf_ap[4] show increasing trend, nacf_ap[3] not too low, nacf_ap[4] not too low, zcr not too high, vER not too low, bER high, zcr very low | X | X |
| UNVOICED | Vad=0 | DEFAULT | X | nacf_ap[2], nacf_ap[3] and nacf_ap[4] show increasing trend, nacf_ap[3] not too low, nacf_ap[4] not too low, zcr not too high, vER not too low, bER high, zcr very low, nacf_ap[3] very high, nacf_ap[4] very high, refl low, E>Eprev, nacf not to low, etc. | X | X |
| VOICED, UP-TRANSIENT, TRANSIENT | Vad=0 | bER<=0, vER very low, E<Eprev, bER>0 | X | X | bER>0, nacf_ap[2], nacf_ap[3] and nacf_ap[4] show increasing trend, zcr not very high, vER not too low, refl low, nacf_ap[3] not too low, nacf not too low bER<=0 | bER>0, nacf_ap[3], not very high, E<Eprev, zcr not too high, vER2<-15 |
| DOWN-TRANSIENT | Vad=0 | DEFAULT | X | X | nacf_ap[2], nacf_ap[3] and nacf_ap[4] show increasing trend, nacf_ap[3] fairly high, nacf_ap[4] fairly high, vER not too low, E>2*Eprev, etc. | vER not too low, zcr low |

FIG. 5B

| CURRENT / PREVIOUS | SILENCE | UNVOICED | VOICED | UP-TRANSIENT | TRANSIENT | DOWN-TRANSIENT |
|---|---|---|---|---|---|---|
| SILENCE | Vad=0 | DEFAULT | X | nacf_ap[2], nacf_ap[3] and nacf_ap[4] show increasing trend, nacf_ap[3] not too low, nacf_ap[4] not too low, zcr not too high, vER not too low, bER high, zcr very low, E>2*Eprev, nacf_ap[3] very high, nacf_ap[4] very high, etc. | X | X |
| UNVOICED | Vad=0 | DEFAULT | X | nacf_ap[2], nacf_ap[3] and nacf_ap[4] show increasing trend, nacf_ap[3] not too low, nacf_ap[4] not too low, zcr not too high, vER not too low, bER high, zcr very low, nacf_ap[3] very high, nacf_ap[4] very high, refl low, E>Eprev, nacf not too low, E>2*Eprev, etc. | X | X |
| VOICED, UP-TRANSIENT, TRANSIENT | Vad=0 | bER<=0, vER very low, E<Eprev, bER>0 | nacf_ap[2]> LOW VOICEDTH, bER>=0, vER not too low, etc. | X | bER>0, nacf_ap[2], nacf_ap[3] and nacf_ap[4] show increasing trend, zcr not very high, vER not too low, refl low, nacf_ap[3] not too low, nacf not too low bER<=0, etc. | bER>0, nacf_ap[3], not very high, E<Eprev, zcr not too high, etc., vER2<-15 |
| DOWN-TRANSIENT | Vad=0 | DEFAULT | X | X | nacf_ap[2], nacf_ap[3] and nacf_ap[4] show increasing trend, nacf_ap[3] fairly high, nacf_ap[4] fairly high, vER not too low, E>2*Eprev, etc. | vER not too low, zcr low |

FIG. 5C

METHOD AND APPARATUS FOR ROBUST SPEECH CLASSIFICATION

BACKGROUND

I. Field

The disclosed embodiments relate to the field of speech processing. More particularly, the disclosed embodiments relate to a novel and improved method and apparatus for robust speech classification.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and re-synthesis at the receiver, a significant reduction in the data rate can be achieved. The more accurately speech analysis can be performed, the more appropriately the data can be encoded, thus reducing the data rate.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder, or a codec. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, de-quantizes them to produce the parameters, and then re-synthesizes the speech frames using the de-quantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_0$, the compression factor achieved by the speech coder is $C_r=N_i/N_0$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_0$ bits per frame. The goal of the speech model is thus to capture the essence of the speech signal, or the target voice quality, with a small set of parameters for each frame.

Speech coders may be implemented as time-domain coders, which attempt to capture the time-domain speech waveform by employing high time-resolution processing to encode small segments of speech (typically 5 millisecond (ms) sub-frames) at a time. For each sub-frame, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques described in A. Gersho & R. M. Gray, *Vector Quantization and Signal Compression* (1992).

A well-known time-domain speech coder is the Code Excited Linear Predictive (CELP) coder described in L. B. Rabiner & R. W. Schafer, *Digital Processing of Speech Signals* 396-453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding of the LP short-term filter coefficients and encoding the LP residue. Time-domain coding can be performed at a fixed rate (i.e., using the same number of bits, $N_0$, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796, which is assigned to the assignee of the presently disclosed embodiments and fully incorporated herein by reference.

Time-domain coders such as the CELP coder typically rely upon a high number of bits, $N_0$, per frame to preserve the accuracy of the time-domain speech waveform. Such coders typically deliver excellent voice quality provided the number of bits, $N_0$, per frame is relatively large (e.g., 8 kbps or above). However, at low bit rates (4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications.

Typically, CELP schemes employ a short term prediction (STP) filter and a long term prediction (LTP) filter. An Analysis by Synthesis (AbS) approach is employed at an encoder to find the LTP delays and gains, as well as the best stochastic codebook gains and indices. Current state-of-the-art CELP coders such as the Enhanced Variable Rate Coder (EVRC) can achieve good quality synthesized speech at a data rate of approximately 8 kilobits per second.

It is also known that unvoiced speech does not exhibit periodicity. The bandwidth consumed encoding the LTP filter in the conventional CELP schemes is not as efficiently utilized for unvoiced speech as for voiced speech, where periodicity of speech is strong and LTP filtering is meaningful. Therefore, a more efficient (i.e., lower bit rate) coding scheme is desirable for unvoiced speech. Accurate speech classification is necessary for selecting the most efficient coding schemes, and achieving the lowest data rate.

For coding at lower bit rates, various methods of spectral, or frequency-domain, coding of speech have been developed, in which the speech signal is analyzed as a time-varying evolution of spectra. See, e.g., R. J. McAulay & T. F. Quatieri, *Sinusoidal Coding*, in *Speech Coding and Synthesis* ch. 4 (W. B. Kleijn & K. K. Paliwal eds., 1995). In spectral coders, the objective is to model, or predict, the short-term speech spectrum of each input frame of speech with a set of spectral parameters, rather than to precisely mimic the time-varying speech waveform. The spectral parameters are then encoded and an output frame of speech is created with the decoded parameters. The resulting synthesized speech does not match the original input speech waveform, but offers similar perceived quality. Examples of frequency-domain coders that are well known in the art include multiband excitation coders (MBEs), sinusoidal transform coders (STCs), and harmonic coders (HCs). Such frequency-domain coders offer a high-quality parametric model having a compact set of parameters that can be accurately quantized with the low number of bits available at low bit rates.

Nevertheless, low-bit-rate coding imposes the critical constraint of a limited coding resolution, or a limited codebook space, which limits the effectiveness of a single coding mechanism, rendering the coder unable to represent various types of speech segments under various background conditions with equal accuracy. For example, conventional low-bit-rate, frequency-domain coders do not transmit phase information for speech frames. Instead, the phase information is reconstructed by using a random, artificially generated, initial phase value and linear interpolation techniques. See, e.g., H. Yang et al., *Quadratic Phase Interpolation for Voiced Speech Synthesis in the MBE Model*, in 29 *Electronic Letters* 856-57 (May 1993). Because the phase information is artificially generated, even if the amplitudes of the sinusoids are perfectly preserved by the quantization_de-quantization process, the output speech produced by the frequency-domain coder will not be aligned with the original input speech (i.e., the major pulses will not be in sync). It has therefore proven difficult to adopt any closed-loop performance measure, such as, e.g., signal-to-noise ratio (SNR) or perceptual SNR, in frequency-domain coders.

One effective technique to encode speech efficiently at low bit rate is multi-mode coding. Multi-mode coding techniques have been employed to perform low-rate speech coding in conjunction with an open-loop mode decision process. One such multi-mode coding technique is described in Amitava Das et al., *Multi-mode and Variable-Rate Coding of Speech*, in *Speech Coding and Synthesis* ch. 7 (W. B. Kleijn & K. K. Paliwal eds., 1995). Conventional multi-mode coders apply different modes, or encoding-decoding algorithms, to different types of input speech frames. Each mode, or encoding-decoding process, is customized to represent a certain type of speech segment, such as, e.g., voiced speech, unvoiced speech, or background noise (non-speech) in the most efficient manner. The success of such multi-mode coding techniques is highly dependent on correct mode decisions, or speech classifications. An external, open loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation. The mode decision is thus made without knowing in advance the exact condition of the output speech, i.e., how close the output speech will be to the input speech in terms of voice quality or other performance measures. An exemplary open-loop mode decision for a speech codec is described in U.S. Pat. No. 5,414,796, which is assigned to the assignee of the present invention and fully incorporated herein by reference.

Multi-mode coding can be fixed-rate, using the same number of bits $N_0$ for each frame, or variable-rate, in which different bit rates are used for different modes. The goal in variable-rate coding is to use only the amount of bits needed to encode the codec parameters to a level adequate to obtain the target quality. As a result, the same target voice quality as that of a fixed-rate, higher-rate coder can be obtained at a significant lower average-rate using variable-bit-rate (VBR) techniques. An exemplary variable rate speech coder is described in U.S. Pat. No. 5,414,796. There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth. A low-rate speech coder coupled with an additional layer of suitable channel coding can fit the overall bit-budget of coder specifications and deliver a robust performance under channel error conditions.

Multi-mode VBR speech coding is therefore an effective mechanism to encode speech at low bit rate. Conventional multi-mode schemes require the design of efficient encoding schemes, or modes, for various segments of speech (e.g., unvoiced, voiced, transition) as well as a mode for background noise, or silence. The overall performance of the speech coder depends on the robustness of the mode classification and how well each mode performs. The average rate of the coder depends on the bit rates of the different modes for unvoiced, voiced, and other segments of speech. In order to achieve the target quality at a low average rate, it is necessary to correctly determine the speech mode under varying conditions. Typically, voiced and unvoiced speech segments are captured at high bit rates, and background noise and silence segments are represented with modes working at a significantly lower rate. Multi-mode variable bit rate encoders require correct speech classification to accurately capture and encode a high percentage of speech segments using a minimal number of bits per frame. More accurate speech classification produces a lower average encoded bit rate, and higher quality decoded speech. Previously, speech classification techniques considered a minimal number of parameters for isolated frames of speech only, producing few and inaccurate speech mode classifications. Thus, there is a need for a high performance speech classifier to correctly classify numerous modes of speech under varying environmental conditions in order to enable maximum performance of multi-mode variable bit rate encoding techniques.

SUMMARY

The disclosed embodiments are directed to a robust speech classification technique that evaluates numerous characteristic parameters of speech to classify various modes of speech with a high degree of accuracy under a variety of conditions. Accordingly, in one aspect, a method of speech classification is disclosed. The method includes inputting classification parameters to a speech classifier from external components, generating, in the speech classifier, internal classification parameters from at least one of the input parameters, setting a Normalized Auto-correlation Coefficient Function threshold and selecting a parameter analyzer according to a signal environment, and analyzing the input parameters and the internal parameters to produce a speech mode classification.

In another aspect, a speech classifier is disclosed. The speech classifier includes a generator for generating internal classification parameters from at least one external input parameter, a Normalized Auto-correlation Coefficient Function threshold generator for setting a Normalized Auto-correlation Coefficient Function threshold and selecting a parameter analyzer according to an a signal environment, and a parameter analyzer for analyzing at least one external input parameter and the internal parameters to produce a speech mode classification.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein:

FIGS. 5A, 5B, and 5C are decision tables used by the disclosed embodiments for speech classification.

DETAILED DESCRIPTION OF THE PREFERRED EMBODIMENTS

The disclosed embodiments provide a method and apparatus for improved speech classification in vocoder applications. Novel classification parameters are analyzed to produce more speech classifications with higher accuracy than previously available. A novel decision making process is used to classify speech on a frame by frame basis. Parameters derived from original input speech, SNR information, noise suppressed output speech, voice activity information, Linear Prediction Coefficient (LPC) analysis, and open loop pitch estimations are employed by a novel state based decision maker to accurately classify various modes of speech. Each frame of speech is classified by analyzing past and future frames, as well as the current frame. Modes of speech that can be classified by the disclosed embodiments comprise transient, transitions to active speech and at end of words, voiced, unvoiced and silence.

The disclosed embodiments present a speech classification technique for a variety of speech modes in environments with varying levels of ambient noise. Speech modes can be reliably and accurately identified for encoding in the most efficient manner.

Figure 1:
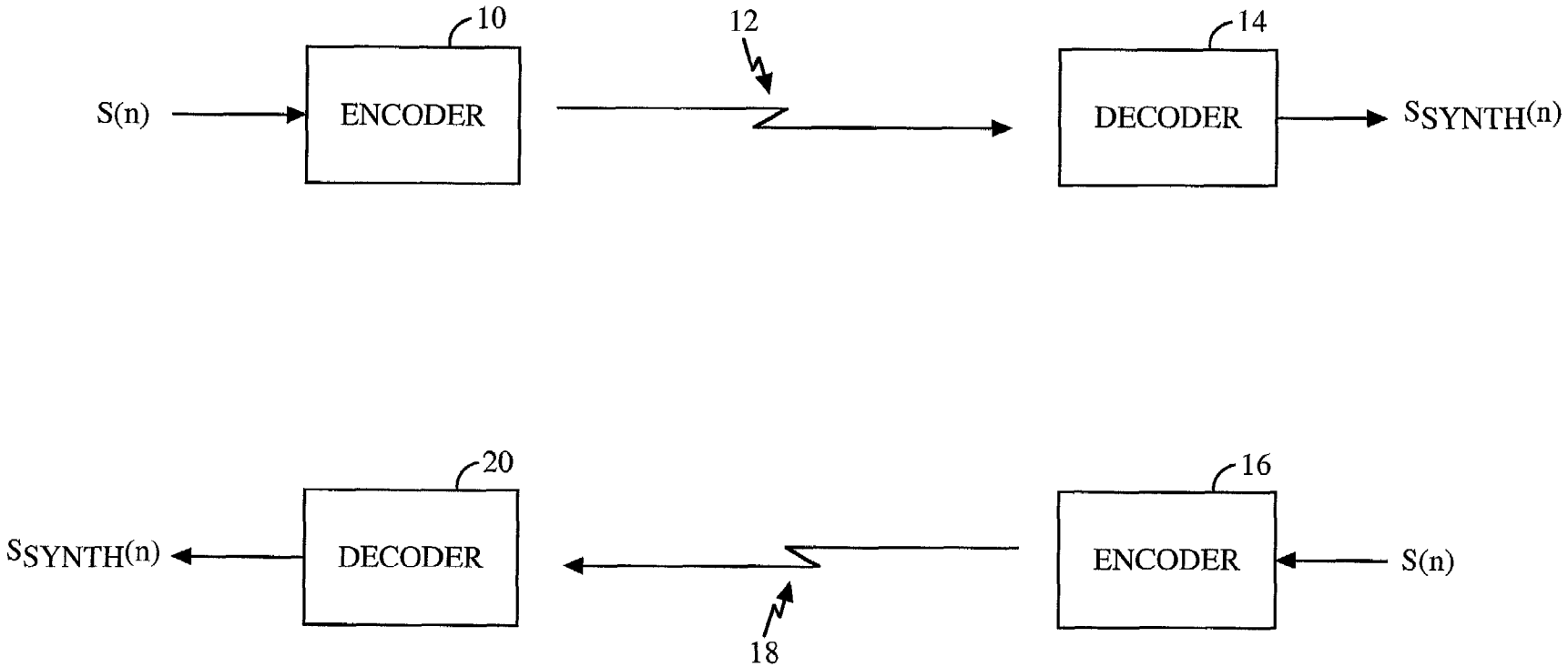
FIG. 1 is a block diagram of a communication channel terminated at each end by speech coders.

In FIG. 1 a first encoder 10 receives digitized speech samples s(n) and encodes the samples s(n) for transmission on a transmission medium 12, or communication channel 12, to a first decoder 14. The decoder 14 decodes the encoded speech samples and synthesizes an output speech signal $s_{SYNTH}(n)$. For transmission in the opposite direction, a second encoder 16 encodes digitized speech samples s(n), which are transmitted on a communication channel 18. A second decoder 20 receives and decodes the encoded speech samples, generating a synthesized output speech signal $s_{SYNTH}(n)$.

The speech samples, s(n), represent speech signals that have been digitized and quantized in accordance with any of various methods known in the art including, e.g., pulse code modulation (PCM), companded μ-law, or A-law. As known in the art, the speech samples, s(n), are organized into frames of input data wherein each frame comprises a predetermined number of digitized speech samples s(n). In an exemplary embodiment, a sampling rate of 8 kHz is embodiments described below, the rate of data transmission may be varied on a frame-to-frame basis from 8 kbps (full rate) to 4 kbps (half rate) to 2 kbps (quarter rate) to 1 kbps (eighth rate). Alternatively, other data rates may be used. As used herein, the terms "full rate" or "high rate" generally refer to data rates that are greater than or equal to 8 kbps, and the terms "half rate" or "low rate" generally refer to data rates that are less than or equal to 4 kbps. Varying the data transmission rate is beneficial because lower bit rates may be selectively employed for frames containing relatively less speech information. As understood by those skilled in the art, other sampling rates, frame sizes, and data transmission rates may be used.

The first encoder 10 and the second decoder 20 together comprise a first speech coder, or speech codec. Similarly, the second encoder 16 and the first decoder 14 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. Nos. 5,727,123 and 5,784,532 assigned to the assignee of the present invention and fully incorporated herein by reference.

Figure 2:
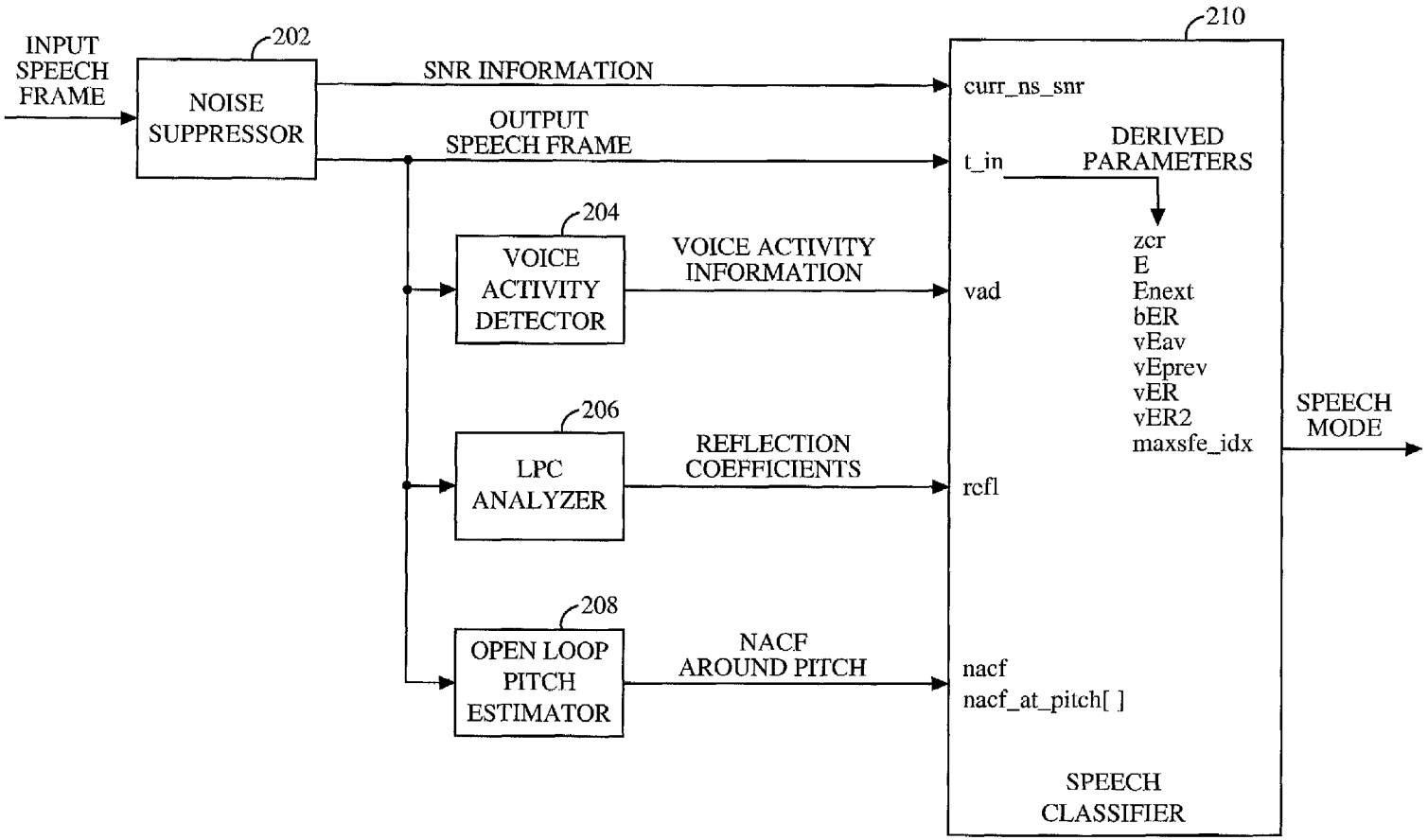
FIG. 2 is a block diagram of a robust speech classifier that can be used by the encoders illustrated in FIG. 1.

FIG. 2 illustrates an exemplary embodiment of a robust speech classifier. In one embodiment, the speech classification apparatus of FIG. 2 can reside in the encoders (10, 16) of FIG. 1. In another embodiment, the robust speech classifier can stand alone, providing speech classification mode output to devices such as the encoders (10, 16) of FIG. 1.

In FIG. 2, input speech is provided to a noise suppresser (202). Input speech is typically generated by analog to digital conversion of a voice signal. The noise suppresser (202) filters noise components from the input speech signal producing a noise suppressed output speech signal, and SNR information for the current output speech. The SNR information and output speech signal are input to speech classifier (210). The output speech signal of the noise suppresser (202) is also input to voice activity detector (204), LPC Analyzer (206), and open loop pitch estimator (208). The SNR information is used by the speech classifier (210) to set periodicity thresholds and to distinguish between clean and noisy speech. The SNR parameter is hereinafter referred to as curr_ns_snr. The output speech signal is hereinafter referred to as t_in. If, in one embodiment, the noise suppressor (202) is not present, or is turned off, the SNR parameter curr_ns_snr should be preset to a default value.

The voice activity detector (204) outputs voice activity information for the current speech to speech classifier (210). The voice activity information output indicates if the current speech is active or inactive. In one exemplary embodiment, the voice activity information output can be binary, i.e., active or inactive. In another embodiment, the voice activity information output can be multi-valued. The voice activity information parameter is herein referred to as vad.

The LPC analyzer (206) outputs LPC reflection coefficients for the current output speech to speech classifier (210).

The LPC analyzer (206) may also output other parameters such as LPC coefficients. The LPC reflection coefficient parameter is herein referred to as refl.

The open loop pitch estimator (208) outputs a Normalized Auto-correlation Coefficient Function NACF) value, and NACF around pitch values, to speech classifier (210). The NACF parameter is hereinafter referred to as nacf, and the NACF around pitch parameter is hereinafter referred to as nacf_at_pitch. A more periodic speech signal produces a higher value of nacf_at_pitch. A higher value of nacf_at_pitch is more likely to be associated with a stationary voice output speech type. Speech classifier (210) maintains an array of nacf_at_pitch values, nacf_at_pitch is computed on a sub-frame basis. In an exemplary embodiment, two open loop pitch estimates are measured for each frame of output speech by measuring two sub-frames per frame. nacf_at_pitch is computed from the open loop pitch estimate for each sub-frame. In the exemplary embodiment, a five dimensional array of nacf_at_pitch values (i.e. nacf_at_pitch[5]) contains values for two and one-half frames of output speech. The nacf_at_pitch array is updated for each frame of output speech. The novel use of an array for the nacf_at_pitch parameter provides the speech classifier (210) with the ability to use current, past, and look ahead (future) signal information to make more accurate and robust speech mode decisions.

In addition to the information input to the speech classifier (210) from external components, the speech classifier (210) internally generates additional novel parameters from the output speech for use in the speech mode decision making process.

In one embodiment, the speech classifier (210) internally generates a zero crossing rate parameter, hereinafter referred to as zcr. The zcr parameter of the current output speech is defined as the number of sign changes in the speech signal per frame of speech. In voiced speech, the zcr value is low, while unvoiced speech (or noise) has a high zcr value because the signal is very random. The zcr parameter is used by the speech classifier (210) to classify voiced and unvoiced speech.

In one embodiment, the speech classifier (210) internally generates a current frame energy parameter, hereinafter referred to as E. E can be used by the speech classifier (210) to identify transient speech by comparing the energy in the current frame with energy in past and future frames. The parameter vEprev is the previous frame energy derived from E.

In one embodiment, the speech classifier (210) internally generates a look ahead frame energy parameter, hereinafter referred to as Enext. Enext may contain energy values from a portion of the current frame and a portion of the next frame of output speech. In one embodiment, Enext represents the energy in the second half of the current frame and the energy in the first half of the next frame of output speech. Enext is used by speech classifier (210) to identify transitional speech. At the end of speech, the energy of the next frame drops dramatically compared to the energy of the current frame. Speech classifier (210) can compare the energy of the current frame and the energy of the next frame to identify end of speech and beginning of speech conditions, or up transient and down transient speech modes.

In one embodiment, the speech classifier (210) internally generates a band energy ratio parameter, defined as log2(EL/EH), where EL is the low band current frame energy from 0 to 2 kHz, and EH is the high band current frame energy from 2 kHz to 4 kHz. The band energy ratio parameter is hereinafter referred to as bER. The bER parameter allows the speech classifier (210) to identify voiced speech and unvoiced speech modes, as in general, voiced speech concentrates energy in the low band, while noisy unvoiced speech concentrates energy in the high band.

In one embodiment, the speech classifier (210) internally generates a three-frame average voiced energy parameter from the output speech, hereinafter referred to as vEav. In other embodiments, vEav may be averaged over a number of frames other than three. If the current speech mode is active and voiced, vEav calculates a running average of the energy in the last three frames of output speech. Averaging the energy in the last three frames of output speech provides the speech classifier (210) with more stable statistics on which to base speech mode decisions than single frame energy calculations alone. vEav is used by the speech classifier (210) to classify end of voice speech, or down transient mode, as the current frame energy, E, will drop dramatically compared to average voice energy, vEav, when speech has stopped. vEav is updated only if the current frame is voiced, or reset to a fixed value for unvoiced or inactive speech. In one embodiment, the fixed reset value is 0.01.

In one embodiment, the speech classifier (210) internally generates a previous three frame average voiced energy parameter, hereinafter referred to as vEprev. In other embodiments, vEprev may be averaged over a number of frames other than three. vEprev is used by speech classifier (210) to identify transitional speech. At the beginning of speech, the energy of the current frame rises dramatically compared to the average energy of the previous three voiced frames. Speech classifier (210) can compare the energy of the current frame and the previous three frames to identify beginning of speech conditions, or up transient and speech modes. Similarly at the end of voiced speech, the energy of the current frame drops off dramatically. Thus, vEprev can also be used to classify transition at end of speech.

In one embodiment, the speech classifier (210) internally generates a current frame energy to previous three-frame average voiced energy ratio parameter, defined as 10*log10 (E/vEprev). In other embodiments, vEprev may be averaged over a number of frames other than three. The current energy to previous three-frame average voiced energy ratio parameter is hereinafter referred to as vER. vER is used by the speech classifier (210) to classify start of voiced speech and end of voiced speech, or up transient mode and down transient mode, as vER is large when speech has started again and is small at the end of voiced speech. The vER parameter may be used in conjunction with the vEprev parameter in classifying transient speech.

In one embodiment, the speech classifier (210) internally generates a current frame energy to three-frame average voiced energy parameter, defined as MIN(20, 10*log10(E/vEav)). The current frame energy to three-frame average voiced energy is hereinafter referred to as vER2. vER2 is used by the speech classifier (210) to classify transient voice modes at the end of voiced speech.

In one embodiment, the speech classifier (210) internally generates a maximum sub-frame energy index parameter. The speech classifier (210) evenly divides the current frame of output speech into sub-frames, and computes the Root Means Squared (RMS) energy value of each sub-frame. In one embodiment, the current frame is divided into ten sub-frames. The maximum sub-frame energy index parameter is the index to the sub-frame that has the largest RMS energy value in the current frame, or in the second half of the current frame. The max sub-frame energy index parameter is hereinafter referred to as maxsfe_idx. Dividing the current frame into sub-frames provides the speech classifier (210) with information about locations of peak energy, including the location of the largest peak energy, within a frame. More resolution is achieved by dividing a frame into more subframes. maxsfe_idx is used in conjunction with other parameters by the speech classifier (210) to classify transient speech modes, as the energies of unvoiced or silence speech modes are generally stable, while energy picks up or tapers off in a transient speech mode.

The speech classifier (210) uses novel parameters input directly from encoding components, and novel parameters generated internally, to more accurately and robustly classify modes of speech than previously possible. The speech Classifier (210) applies a novel decision making process to the directly input and internally generated parameters to produce improved speech classification results. The decision making process is described in detail below with references to FIGS. 4A-4C and 5A-5C.

In one embodiment, the speech modes output by speech Classifier (210) comprise: Transient, Up-Transient, Down-Transient, Voiced, Unvoiced, and Silence modes. Transient mode is a voiced but less periodic speech, optimally encoded with full rate CELP. Up-transient mode is the first voiced frame in active speech, optimally encoded with full rate CELP. Down-transient mode is low energy voiced speech typically at the end of a word, optimally encoded with half rate CELP. Voiced mode is a highly periodic voiced speech, comprising mainly vowels. Voiced mode speech may be encoded at full rate, half rate, quarter rate, or eighth rate. The data rate for encoding voiced mode speech is selected to meet Average Data Rate (ADR) requirements. Unvoiced mode, comprising mainly consonants, is optimally encoded with quarter rate Noise Excited Linear Prediction (NELP). Silence mode is inactive speech, optimally encoded with eighth rate CELP.

One skilled in the art would understand that the parameters and speech modes are not limited to the parameters and speech modes of the disclosed embodiments. Additional parameters and speech modes can be employed without departing from the scope of the disclosed embodiments.

Figure 3:
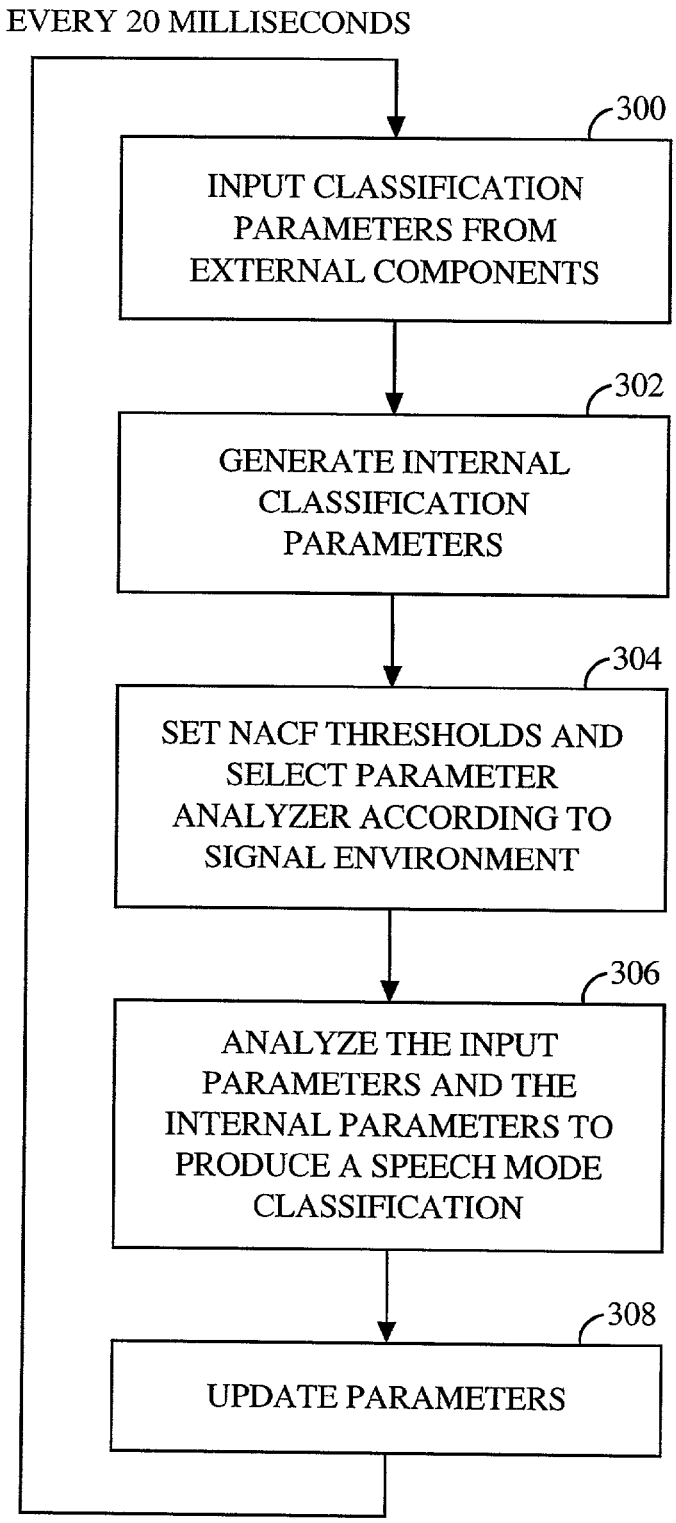
FIG. 3 is a flow chart illustrating speech classification steps of a robust speech classifier.

FIG. 3 is a flow chart illustrating one embodiment of the speech classification steps of a robust speech classification technique.

In step 300, classification parameters input from external components are processed for each frame of noise suppressed output speech. In one embodiment, classification parameters input from external components comprise curr_ns_snr and t_in input from a noise suppresser component, nacf and nacf_at_pitch parameters input from an open loop pitch estimator component, vad input from a voice activity detector component, and refl input from an LPC analysis component. Control flow proceeds to step 302.

In step 302, additional internally generated parameters are computed from classification parameters input from external components. In an exemplary embodiment, zcr, E, Enext, bER, vEav, vEprev, vER, vER2 and maxsfe_idx are computed from t_in. When internally generated parameters have been computed for each output speech frame, control flow proceeds to step 304.

In step 304, NACF thresholds are determined, and a parameter analyzer is selected according to the environment of the speech signal. In an exemplary embodiment, the NACF threshold is determined by comparing the curr_ns_snr parameter input in step 300 to a SNR threshold value. The curr_ns_snr information, derived from the noise suppressor, provides a novel adaptive control of a periodicity decision threshold. In this manner, different periodicity thresholds are applied in the classification process for speech signals with different levels of noise components. A more accurate speech classification decision is produced when the most appropriate nacf, or periodicity, threshold for the noise level of the speech signal is selected for each frame of output speech. Determining the most appropriate periodicity threshold for a speech signal allows the selection of the best parameter analyzer for the speech signal.

Clean and noisy speech signals inherently differ in periodicity. When noise is present, speech corruption is present. When speech corruption is present, the measure of the periodicity, or nacf, is lower than that of clean speech. Thus, the nacf threshold is lowered to compensate for a noisy signal environment or raised for a clean signal environment. The novel speech classification technique of the disclosed embodiments does not fix periodicity thresholds for all environments, producing a more accurate and robust mode decision regardless of noise levels.

In an exemplary embodiment, if the value of curr_ns_snr is greater than or equal to a SNR threshold of 25 db, nacf thresholds for clean speech are applied. Exemplary nacf thresholds for clean speech are defined by the following table:

TABLE 1

| Threshold for Type | Threshold Name | Threshold Value |
|---|---|---|
| Voiced | VOICEDTH | .75 |
| Transitional | LOWVOICEDTH | .5 |
| Unvoiced | UNVOICEDTH | .35 |

In the exemplary embodiment, if the value of curr ns snr is less than a SNR threshold of 25 db, nacf thresholds for noisy speech are applied. Exemplary nacf thresholds for noisy speech are defined by the following table:

TABLE 2

| Threshold for Type | Threshold Name | Threshold Value |
|---|---|---|
| Voiced | VOICEDTH | .65 |
| Transitional | LOWVOICEDTH | .5 |
| Unvoiced | UNVOICEDTH | .35 |

Noisy speech is the same as clean speech with added noise. With adaptive periodicity threshold control, the robust speech classification technique is more likely to produce identical classification decisions for clean and noisy speech than previously possible. When the nacf thresholds have been set for each frame, control flow proceeds to step 306.

In step 306, the parameters input from external components and the internally generated parameters are analyzed to produce a speech mode classification. A state machine or any other method of analysis selected according to the signal environment is applied to the parameters. In an exemplary embodiment, the parameters input from external components and the internally generated parameters are applied to a state based mode decision making process described in detail with reference to FIGS. 4A-4C and 5A-5C. The decision making process produces a speech mode classification. In an exemplary embodiment, a speech mode classification of Transient, Up-Transient, Down Transient, Voiced, Unvoiced, or Silence is produced. When a speech mode decision has been produced, control flow proceeds to step 308.

In step 308, state variables and various parameters are updated to include the current frame. In an exemplary embodiment, vEav, vEprev, and the voiced state of the current frame are updated. The current frame energy E, nacf_at_pitch, and the current frame speech mode are updated for classifying the next frame.

Steps 300-308 are repeated for each frame of speech.

Figure 4A:
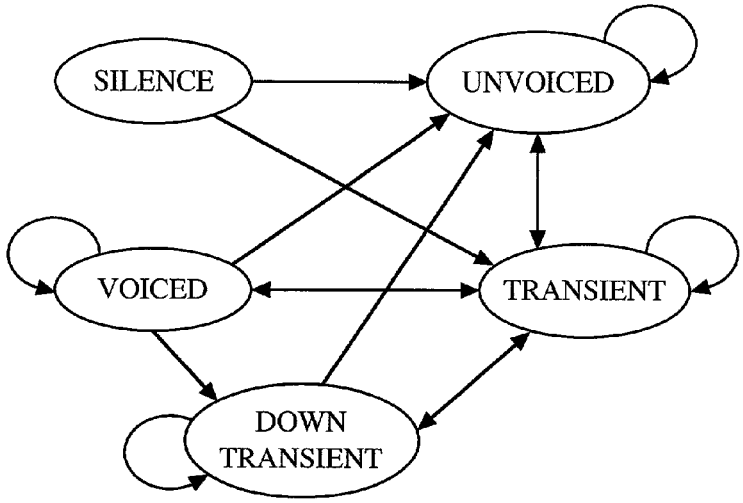
FIGS. 4A, 4B, and 4C are state diagrams used by the disclosed embodiments for speech classification.
Figure 4B:
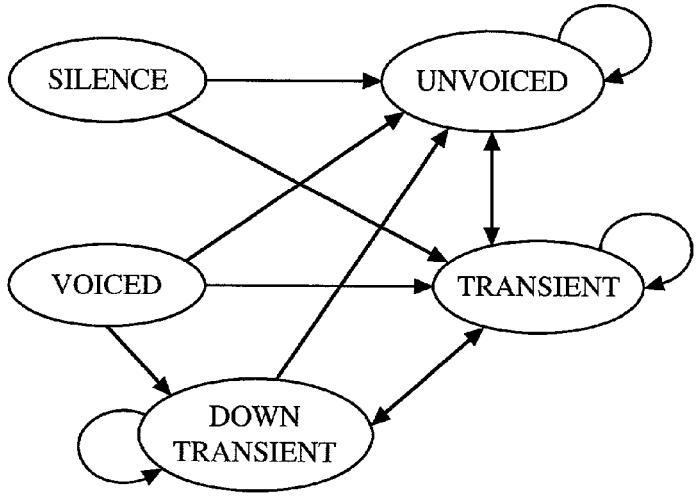
Figure 4C:
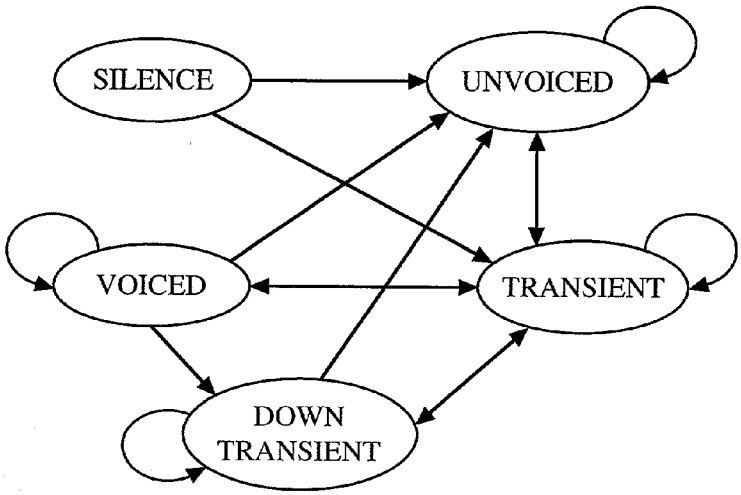

FIGS. 4A-4C illustrate embodiments of the mode decision making processes of an exemplary embodiment of a robust speech classification technique. The decision making process selects a state machine for speech classification based on the periodicity of the speech frame. For each frame of speech, a state machine most compatible with the periodicity, or noise component, of the speech frame is selected for the decision making process by comparing the speech frame periodicity measure, i.e. nacf_at_pitch value, to the NACF thresholds set in step 304 of FIG. 3. The level of periodicity of the speech frame limits and controls the state transitions of the mode decision process, producing a more robust classification.

FIG. 4A illustrates one embodiment of the state machine selected in the exemplary embodiment when vad is 1 (there is active speech) and the third value of nacf_at_pitch (i.e. nacf_at_pitch[2], zero indexed) is very high, or greater than VOICEDTH. VOICEDTH is defined in step 304 of FIG. 3. FIG. 5A illustrates the parameters evaluated by each state.

The initial state is silence. The current frame will always be classified as Silence, regardless of the previous state, if vad=0 (i.e there is no voice activity).

When the previous state is silence, the current frame may be classified as either Unvoiced or Up-transient. The current frame is classified as Unvoiced if nacf_at_pitch[3] is very low, zcr is high, bER is low and vER is very low, or if a combination of these conditions are met. Otherwise the classification defaults to Up-Transient.

When the previous state is Unvoiced, the current frame may be classified as Unvoiced or Up-Transient. The current frame remains classified as Unvoiced if nacf is very low, nacf_at_pitch[3] is very low, nacf_at_pitch[4] is very low, zcr is high, bER is low, vER is very low, and E is less than vEprev, or if a combination of these conditions are met. Otherwise the classification defaults to Up-Transient.

When the previous state is Voiced, the current frame may be classified as Unvoiced, Transient, Down-Transient, or Voiced. The current frame is classified as Unvoiced if vER is very low, and E is less than vEprev. The current frame is classified as Transient if nacf_at_pitch[1] and nacf_at_pitch [3] are low, E is greater than half of vEprev, or a combination of these conditions are met. The current frame is classified as Down-Transient if vER is very low, and nacf_at_pitch[3] has a moderate value. Otherwise, the current classification defaults to Voiced.

When the previous state is Transient or Up-Transient, the current frame may be classified as Unvoiced, Transient, Down-Transient or Voiced. The current frame is classified as Unvoiced if vER is very low, and E is less than vEprev. The current frame is classified as Transient if nacf_at_pitch[1] is low, nacf_at_pitch[3] has a moderate value, nacf_at_pitch[4] is low, and the previous state is not Transient, or if a combination of these conditions are met. The current frame is classified as Down-Transient if nacf_at_pitch[3] has a moderate value, and E is less than 0.05 times vEav. Otherwise, the current classification defaults to Voiced.

When the previous frame is Down-Transient, the current frame may be classified as Unvoiced, Transient or Down-Transient. The current frame will be classified as Unvoiced if vER is very low. The current frame will be classified as Transient if E is greater than vEprev. Otherwise, the current classification remains Down-Transient.

FIG. 4B illustrates one embodiment of the state machine selected in the exemplary embodiment when vad is 1 (there is active speech) and the third value of nacf_at_pitch is very low, or less than UNVOICEDTH. UNVOICEDTH is defined in step 304 of FIG. 3. FIG. 5B illustrates the parameters evaluated by each state.

The initial state is silence. The current frame will always be classified as Silence, regardless of the previous state, if vad=0 (i.e there is no voice activity).

When the previous state is silence, the current frame may be classified as either Unvoiced or Up-transient. The current frame is classified as Up-Transient if nacf_at_pitch[2-4] show an increasing trend, nacf_at_pitch[3-4] have a moderate value, zcr is very low to moderate, bER is high, and vER has a moderate value, or if a combination of these conditions are met. Otherwise the classification defaults to Unvoiced.

When the previous state is Unvoiced, the current frame may be classified as Unvoiced or Up-Transient. The current frame is classified as Up-Transient if nacf_at_pitch[2-4] show an increasing trend, nacf_at_pitch[3-4] have a moderate to very high value, zcr is very low or oderste, vER is not low, bER is high, refl is low, nacf has moderate value and E is greater than vEprev, or if a combination of these conditions is met. The combinations and thresholds for these conditions may vary depending on the noise level of the speech frame as reflected in the parameter curr_ns_snr. Otherwise the classification defaults to Unvoiced.

When the previous state is Voiced, Up-Transient, or Transient, the current frame may be classified as Unvoiced, Transient, or Down-Transient. The current frame is classified as Unvoiced if bER is less than or eqaul to zero, vER is very low, bER is greater than zero, and E is less than vEprev, or if a combination of these conditions are met. The current frame is classified as Transient if bER is greater than zero, nacf_at_pitch[2-4] show an increasing trend, zcr is not high, vER is not low, refl is low, nacf_at_pitch[3] and nacf are moderate and bER is less than or equal to zero, or if a certain combination of these conditions are met. The combinations and thresholds for these conditions may vary depending on the noise level of the speech frame as reflected in the parameter curr_ns_. The current frame is classified as Down-Transient if, bER is greater than zero, nacf_at_pitch[3] is moderate, E is less than vEprev, zcr is not high, and vER2 is less then negative fifteen.

When the previous frame is Down-Transient, the current frame may be classified as Unvoiced, Transient or Down-Transient. The current frame will be classified as Transient if nacf_at_pitch[2-4] shown an increasing trend, nacf_at_pitch [3-4] are moderately high, vER is not low, and E is greater than twice vEprev, or if a combination of these conditions are met. The current frame will be classified as Down-Transient if vER is not low and zcr is low. Otherwise, the current classification defaults to Unvoiced.

FIG. 4C illustrates one embodiment of the state machine selected in the exemplary embodiment when vad is 1 (there is active speech) and the third value of nacf_at_pitch (i.e. nacf_at_pitch[3]) is moderate, i.e., greater than UNVOICEDTH and less than VOICEDTH. UNVOICEDTH and VOICEDTH are defined in step 304 of FIG. 3. FIG. 5C illustrates the parameters evaluated by each state.

The initial state is silence. The current frame will always be classified as Silence, regardless of the previous state, if vad=0 (i.e there is no voice activity).

When the previous state is silence, the current frame may be classified as either Unvoiced or Up-transient. The current frame is classified as Up-Transient if nacf_at_pitch[2-4] shown an increasing trend, nacf_at_pitch[3-4] are moderate to high, zcr is not high, bER is high, vER has a moderate value, zcr is very low and E is greater than twice vEprev, or if a certain combination of these conditions am met. Otherwise the classification defaults to Unvoiced.

When the previous state is Unvoiced, the current frame may be classified as Unvoiced or Up-Transient. The current frame is classified as Up-Transient if nacf_at_pitch[2-4] shown an increasing trend, nacf_at_pitch[3-4] have a moderate to very high value, zcr is not high, vER is not low, bER is high, refl is low, E is greater than vEprev, zcr is very low, nacf is not low, maxsfe_idx points to the last subframe and E is greater than twice vEprev, or if a combination of these conditions are met. The combinations and thresholds for these conditions may vary depending on the noise level of the speech frame as reflected in the parameter curr_ns_snr. Otherwise the classification defaults to Unvoiced.

When the previous state is Voiced, Up-Transient, or Transient, the current frame may be classified as Unvoiced, Voiced, Transient, Down-Transient. The current frame is classified as Unvoiced if bER is less than or eqaul to zero, vER is very low, Enext is less than E, nacf_at_pitch[3-4] are very low, bER is greater than zero and E is less than vEprev, or if a certain combination of these conditions are met. The current frame is classified as Transient if bER is greater than zero, nacf_at_pitch[2-4] show an increasing trend, zcr is not high, vER is not low, refl is low, nacf_at_pitch[3] and nacf are not low, or if a combination of these conditions are met. The combinations and thresholds for these conditions may vary depending on the noise level of the speech frame as reflected in the parameter curr_ns_snr. The current frame is classified as Down-Transient if, bER is greater than zero, nacf_at_pitch [3] is not high, E is less than vEprev, zcr is not high, vER is less than negative fifteen and vER2 is less then negative fifteen, or if a combination of these conditions are met. The current frame is classified as Voiced if nacf_at_pitch[2] is greater than LOWVOICEDTH, bER is greater than or equal to zero, and vER is not low, or if a combination of these conditions are met.

When the previous frame is Down-Transient, the current frame may be classified as Unvoiced, Transient or Down-Transient. The current frame will be classified as Transient if bER is greater than zero, nacf_at_pitch[2-4] show an increasing trend, nacf_at_pitch[3-4] are moderately high, vER is not low, and E is greater than twice vEprev, or if a certain combination of these conditions are met. The current frame will be classified as Down-Transient if vER is not low and zcr is low. Otherwise, the current classification defaults to Unvoiced.

FIG. 5A-5C are embodiments of decision tables used by the disclosed embodiments for speech classification.

FIG. 5A, in accordance with one embodiment, illustrates the parameters evaluated by each state, and the state transitions when the third value of nacf_at_pitch (i.e. nacf_at_pitch [2]) is very high, or greater than VOICEDTH. The decision table illustrated in FIG. 5A is used by the state machine described in FIG. 4A. The speech mode classification of the previous frame of speech is shown in the leftmost column. When parameters are valued as shown in the row associated with each previous mode, the speech mode classification transitions to the current mode identified in the top row of the associated column.

FIG. 5B illustrates, in accordance with one embodiment, the parameters evaluated by each state, and the state transitions when the third value (i.e. nacf_at_pitch[2]) is very low, or less than UNVOICEDTH. The decision table illustrated in FIG. 5B is used by the state machine described in FIG. 4B. The speech mode classification of the previous frame of speech is shown in the leftmost column. When parameters are valued as shown in the row associated with each previous mode, the speech mode classification transitions to the current mode identified in the top row of the associated column.

FIG. 5C illustrates, in accordance with one embodiment, the parameters evaluated by each state, and the state transitions when the third value of nacf_at_pitch (i.e. nacf_at_pitch [3]) is moderate, i.e., greater than UNVOICEDTH but less than VOICEDTH. The decision table illustrated in FIG. 5C is used by the state machine described in FIG. 4C. The speech mode classification of the previous frame of speech is shown in the leftmost column. When parameters are valued as shown in the row associated with each previous mode, the speech mode classification transitions to the current mode identified in the top row of the associated column.

Figure 6:
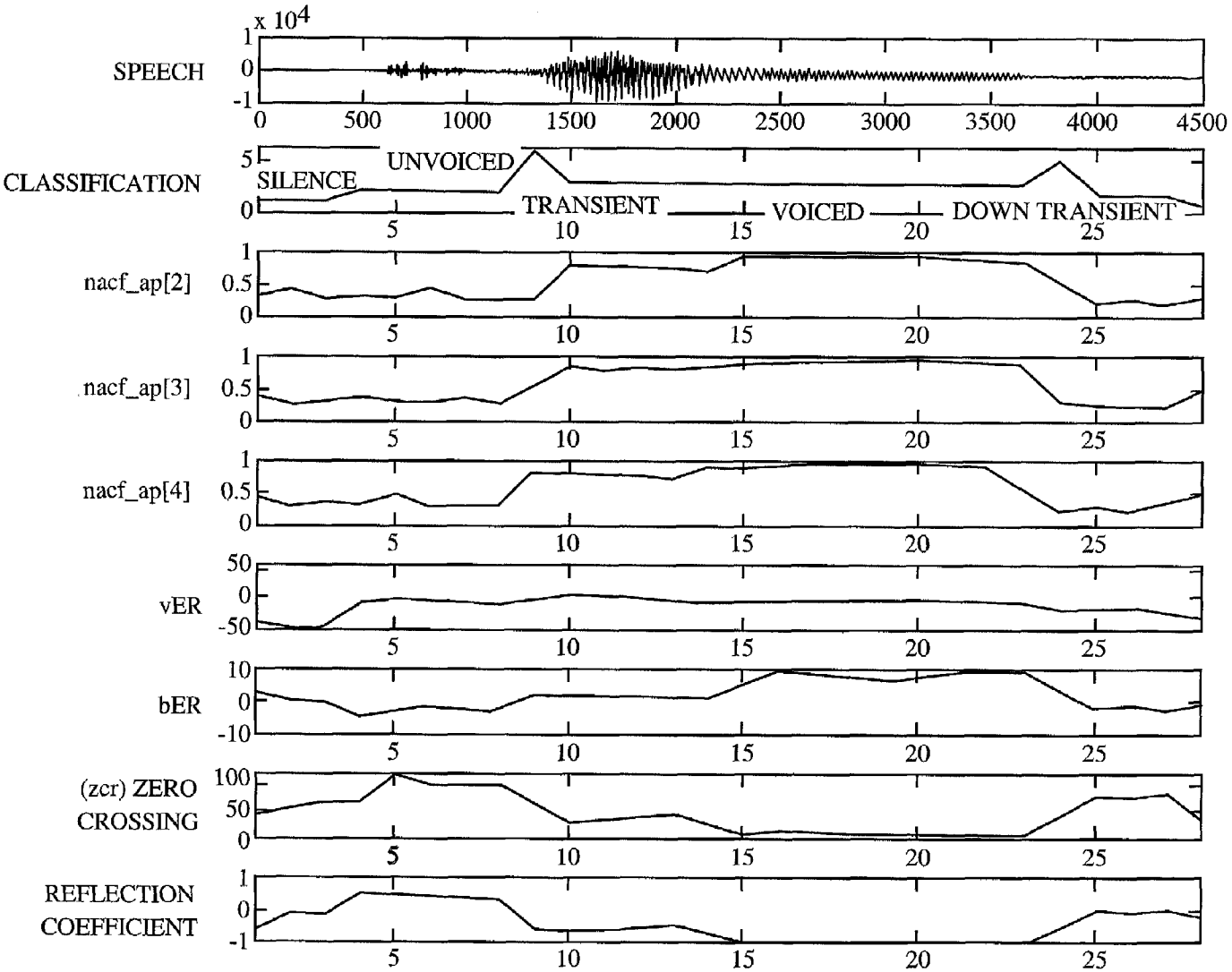
FIG. 6 is an exemplary graph of one embodiment of a speech signal with classification parameter, and speech mode values.

FIG. 6 is a timeline graph of an exemplary embodiment of a speech signal with associated parameter values, and speech classifications.

It is understood by those of skill in the art that speech classifiers may be implemented with a DSP, an ASIC, discrete gate logic, firmware, or any conventional programmable software module and a microprocessor. The software module could reside in RAM memory, flash memory, registers, or any other form of writeable storage medium known in the art. Alternatively, any conventional processor, controller, or state machine could be substituted for the microprocessor.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. A method of speech classification, comprising:

inputting parameters to a speech classifier, the parameters comprising speech samples, a signal to noise ratio (SNR) of the speech samples, a voice activity decision, a Normalized Auto-correlation Coefficient Function (NACF) value based on a pitch estimation, and Normalized Auto-correlation Coefficient Function (NACF) at pitch information;

generating, in the speech classifier, internal parameters from the input parameters;

setting a Normalized Auto-correlation Coefficient Function (NACF) threshold value for voiced speech, transitional speech and unvoiced speech based on the signal to noise ratio of the speech samples, wherein the NACF threshold value for voiced speech in a noisy speech environment is lower than the NACF threshold value for voiced speech in a clean speech environment; and analyzing the input parameters and the internal parameters to produce a speech mode classification from a group comprising a transient mode, a voiced mode, and an unvoiced mode.

2. The method of claim 1 wherein the speech samples comprise noise suppressed speech samples.

3. The method of claim 1 wherein the input parameters comprise Linear Prediction reflection coefficients.

4. The method of claim 1 further comprising maintaining an array of Normalized Auto-correlation Coefficient Function at pitch information values for a plurality of frames.

5. The method of claim 1 wherein the internal parameters comprise a zero crossing rate parameter.

6. The method of claim 1 wherein the internal parameters comprise a current frame energy parameter.

7. The method of claim 1 wherein the internal parameters comprise a look ahead frame energy parameter.

8. The method of claim 1 wherein the internal parameters comprise a band energy ratio parameter.

9. The method of claim 1 wherein the internal parameters comprise a three frame averaged voiced energy parameter.

10. The method of claim 1 wherein the internal parameters comprise a previous three frame average voiced energy parameter.

11. The method of claim 1 wherein the internal parameters comprise a current frame energy to previous three frame average voiced energy ratio parameter.

12. The method of claim 1 wherein the internal parameters comprise a current frame energy to three frame average voiced energy parameter.

13. The method of claim 1 wherein the internal parameters comprise a maximum sub-frame energy index parameter.

14. The method of claim 1 wherein the setting the Normalized Auto-correlation Coefficient Function threshold comprises comparing the signal to noise ratio of the speech samples to a pre-determined signal to noise ratio value.

15. The method of claim 1 wherein the analyzing comprises:

selecting a state machine among a plurality of state machines by comparing the Normalized Auto-correlation Coefficient Function (NACF) at pitch information with the Normalized Auto-correlation Coefficient Function threshold; and applying the parameters to the selected state machine.

16. The method of claim 15 wherein the state machine comprises a state for each speech classification mode.

17. The method of claim 1 wherein the speech mode classification comprises an Up-Transient mode.

18. The method of claim 1 wherein the speech mode classification comprises a Down-Transient mode.

19. The method of claim 1 wherein the speech mode classification comprises a Silence mode.

20. The method of claim 1 further comprising updating at least one parameter.

21. The method of claim 20 wherein the updated parameter comprises the Normalized Auto-correlation Coefficient Function at pitch information.

22. The method of claim 20 wherein the updated parameter comprises a three frame averaged voiced energy parameter.

23. The method of claim 20 wherein the updated parameter comprises a look ahead frame energy parameter.

24. The method of claim 20 wherein the updated parameter comprises a previous three frame average voiced energy parameter.

25. The method of claim 20 wherein the updated parameter comprises a voice activity detection parameter.

26. An apparatus comprising:

a speech classifier configured to receive input parameters including speech samples, a signal to noise ratio (SNR) of the speech samples, a voice activity decision, a Normalized Auto-correlation Coefficient Function (NACF) value based on a pitch estimation, and Normalized Auto-correlation Coefficient Function (NACF) at pitch information;

the speech classifier comprising:

a generator to generate internal parameters from the input parameters;

a Normalized Auto-correlation Coefficient Function threshold generator for setting a Normalized Auto-correlation Coefficient Function threshold value for voiced speech, transitional speech and unvoiced speech based on the signal to noise ratio of the speech samples, wherein the NACF threshold value for voiced speech in a noisy speech environment is lower than the NACF threshold value for voiced speech in a clean speech environment; and a parameter analyzer for analyzing the input parameters and the internal parameters to produce a speech mode classification from a group comprising a transient mode, a voiced mode, and an unvoiced mode.

27. The apparatus of claim 26 wherein the speech samples comprise noise suppressed speech samples.

28. The apparatus of claim 26, wherein the speech classifier is configured to further receive Linear Prediction reflection coefficients, wherein the generator generates internal parameters from the Linear Prediction reflection coefficients.

29. The apparatus of claim 26, wherein the speech classifier is further configured to maintain an array of Normalized Auto-correlation Coefficient Function at pitch information values for a plurality of frames.

30. The apparatus of claim 26 wherein the generated parameters comprise a zero crossing rate parameter.

31. The apparatus of claim 26 wherein the generated parameters comprise a current frame energy parameter.

32. The apparatus of claim 26 wherein the generated parameters comprise a look ahead frame energy parameter.

33. The apparatus of claim 26 wherein the generated parameters comprise a band energy ratio parameter.

34. The apparatus of claim 26 wherein the generated parameters comprise a three frame averaged voiced energy parameter.

35. The apparatus of claim 26 wherein the generated parameters comprise a previous three frame average voiced energy parameter.

36. The apparatus of claim 26 wherein the generated parameters comprise a current frame energy to previous three frame average voiced energy ratio parameter.

37. The apparatus of claim 26 wherein the generated parameters comprise a current frame energy to three frame average voiced energy parameter.

38. The apparatus of claim 26 wherein the generated parameters comprise a maximum sub-frame energy index parameter.

39. The apparatus of claim 26 wherein the setting the Normalized Auto-correlation Coefficient Function threshold comprises comparing the signal to noise ratio of the speech samples to a pre-determined signal to noise ratio value.

40. The apparatus of claim 26 wherein the parameter analyzer is configured to select a state machine among a plurality of state machines by comparing the Normalized Auto-correlation Coefficient Function (NACF) at pitch information with the Normalized Auto-correlation Coefficient Function threshold and apply the parameters to the selected state machine.

41. The apparatus of claim 40 wherein the state machine comprises a state for each speech classification mode.

42. The apparatus of claim 26 wherein the speech mode classification comprises an Up-Transient mode.

43. The apparatus of claim 26 wherein the speech mode classification comprises a Down-Transient mode.

44. The apparatus of claim 26 wherein the speech mode classification comprises a Silence mode.

45. The apparatus of claim 26 further comprising updating at least one parameter.

46. The apparatus of claim 45 wherein the updated parameter comprises the Normalized Auto-correlation Coefficient Function at pitch information.

47. The apparatus of claim 45 wherein the updated parameter comprises a three frame averaged voiced energy parameter.

48. The apparatus of claim 45 wherein the updated parameter comprises a look ahead frame energy parameter.

49. The apparatus of claim 45 wherein the updated parameter comprises a previous three frame average voiced energy parameter.

50. The apparatus of claim 45 wherein the updated parameter comprises a voice activity detection parameter.

51. A method comprising:

comparing signal-to-noise-ratio (SNR) information for a set of speech samples to a SNR threshold value;

based on comparing the SNR information to the SNR threshold value, determining Normalized Auto-correlation Coefficient Function (NACF) thresholds, wherein the NACF thresholds comprise a first threshold for voiced speech, a second threshold for transitional speech, and a third threshold for unvoiced speech, wherein the first NACF thresholds for voiced speech in a noisy speech environment are lower than the first NACF thresholds for voiced speech in a clean speech environment;

comparing a NACF at pitch value with the NACF thresholds; and based on comparing the NACF at pitch value with the NACF thresholds, selecting a parameter analyzer from among a plurality of parameter analyzers to analyze a plurality of parameters and classify the set of speech samples as silence, voiced, unvoiced or transient speech.

52. The method of claim 51 wherein each parameter analyzer comprises a state machine with silence, voiced, unvoiced and transient speech states.

53. The method of claim 51, wherein determining NACF thresholds comprises selecting between a first set of NACF thresholds corresponding to clean speech and a second set of NACF thresholds corresponding to noisy speech.

54. The method of claim 51, wherein the NACF thresholds comprise a first threshold for voiced speech, a second threshold for transitional speech, and a third threshold for unvoiced speech.

55. The method of claim 51, further comprising estimating a pitch to determine the NACF at pitch value.

56. An apparatus comprising:

a speech classifier configured to:

compare signal-to-noise-ratio (SNR) information for a set of speech samples to a SNR threshold value;

based on comparing the SNR information to the SNR threshold value, determine Normalized Auto-correlation Coefficient Function (NACF) thresholds, wherein the NACF thresholds comprise a first threshold for voiced speech, a second threshold for transitional speech, and a third threshold for unvoiced speech and wherein the first NACF threshold for voiced speech in a noisy speech environment is lower than the first NACF threshold for voiced speech in a clean speech environment;

compare a NACF at pitch value with the NACF thresholds; and based on comparing the NACF at pitch value with the NACF thresholds, select a parameter analyzer from among a plurality of parameter analyzers to analyze a plurality of parameters and classify the set of speech samples as silence, voiced, unvoiced or transient speech.

57. The apparatus of claim 56, wherein each parameter analyzer comprises a state machine with silence, voiced, unvoiced and transient speech states.

58. The apparatus of claim 56, wherein determining NACF thresholds comprises selecting between a first set of NACF thresholds corresponding to clean speech and a second set of NACF thresholds corresponding to noisy speech.

59. The apparatus of claim 56, further comprising a pitch estimator configured to estimate a pitch to determine the NACF at pitch value.

60. An apparatus for classifying speech, comprising:

means for inputting parameters to a speech classifier, the parameters comprising speech samples, a signal to noise ratio (SNR) of the speech samples, a voice activity decision, a Normalized Auto-correlation Coefficient Function (NACF) value based on a pitch estimation, and Normalized Auto-correlation Coefficient Function (NACF) at pitch information;

means for generating, in the speech classifier, internal parameters from the input parameters;

means for setting a Normalized Auto-correlation Coefficient Function (NACF) threshold value for voiced speech, transitional speech and unvoiced speech based on the signal to noise ratio of the speech samples, wherein the NACF threshold value for voiced speech in a noisy speech environment is lower than the NACF threshold value for voiced speech in a clean speech environment; and means for analyzing the input parameters and the internal parameters to produce a speech mode classification from a group comprising a transient mode, a voiced mode, and an unvoiced mode.

61. An apparatus for classifying speech, comprising:

means for comparing signal-to-noise-ratio (SNR) information for a set of speech samples to a SNR threshold value;

based on comparing the SNR information to the SNR threshold value, means for determining Normalized Auto-correlation Coefficient Function (NACF) thresholds, wherein the NACF thresholds comprise a first threshold for voiced speech, a second threshold for transitional speech, and a third threshold for unvoiced speech, wherein the first NACF thresholds for voiced speech in a noisy speech environment are lower than the first NACF thresholds for voiced speech in a clean speech environment;

means for comparing a NACF at pitch value with the NACF thresholds; and based on comparing the NACF at pitch value with the NACF thresholds, means for selecting a parameter analyzer from among a plurality of parameter analyzers to analyze a plurality of parameters and classify the set of speech samples as silence, voiced, unvoiced or transient speech.

62. A computer-program product for classifying speech, the computer-program product comprising a computer readable medium having instructions thereon, the instructions comprising:

code for inputting parameters to a speech classifier, the parameters comprising speech samples, a signal to noise ratio (SNR) of the speech samples, a voice activity decision, a Normalized Auto-correlation Coefficient Function (NACF) value based on a pitch estimation, and Normalized Auto-correlation Coefficient Function (NACF) at pitch information;

code for generating, in the speech classifier, internal parameters from the input parameters;

code for setting a Normalized Auto-correlation Coefficient Function (NACF) threshold value for voiced speech, transitional speech and unvoiced speech based on the signal to noise ratio of the speech samples, wherein the NACF threshold value for voiced speech in a noisy speech environment is lower than the NACF threshold value for voiced speech in a clean speech environment; and code for analyzing the input parameters and the internal parameters to produce a speech mode classification from a group comprising a transient mode, a voiced mode, and an unvoiced mode.

63. A computer-program product for classifying speech, the computer-program product comprising a computer readable medium having instructions thereon, the instructions comprising:

code for comparing signal-to-noise-ratio (SNR) information for a set of speech samples to a SNR threshold value;

based on comparing the SNR information to the SNR threshold value, code for determining Normalized Autocorrelation Coefficient Function (NACF) thresholds, wherein the NACF thresholds comprise a first threshold for voiced speech, a second threshold for transitional speech, and a third threshold for unvoiced speech, wherein the first NACF thresholds for voiced speech in a noisy speech environment are lower than the first NACF thresholds for voiced speech in a clean speech environment;

code for comparing a NACF at pitch value with the NACF thresholds; and based on comparing the NACF at pitch value with the NACF thresholds, code for selecting a parameter analyzer from among a plurality of parameter analyzers to analyze a plurality of parameters and classify the set of speech samples as silence, voiced, unvoiced or transient speech.

* * * * *